US005651216A

United States Patent [19]

Tillmann

[11] Patent Number: 5,651,216

[45] Date of Patent: Jul. 29, 1997

[54] DOOR CLOSER FOR A TWO-PANEL DOOR WITH A CLOSING SEQUENCE CONTROL MECHANISM

[75] Inventor: Horst Tillmann, Ennepetal, Germany

[73] Assignee: Dorma GmbH & Co. KG, Ennepetal, Germany

[21] Appl. No.: 597,131

[22] Filed: Feb. 6, 1996

[30] Foreign Application Priority Data

Feb. 7, 1995 [DE] Germany ..... 295 01 776.7

[51] Int. Cl.[6] ..... E05C 7/04; E05D 15/18; E06B 3/32

[52] U.S. Cl. ..... 49/367

[58] Field of Search ..... 49/367, 368, 369, 49/366; 16/82

[56] References Cited

U.S. PATENT DOCUMENTS

| | | | |
|---|---|---|---|
| 3,822,506 | 7/1974 | Fishbach | 49/367 |
| 3,895,461 | 7/1975 | Maynard, Jr. et al. | 49/367 |
| 4,429,492 | 2/1984 | Imhoff | 49/367 |
| 4,949,505 | 8/1990 | Cohrs | 49/367 |
| 4,967,512 | 11/1990 | Schroder et al. | 49/367 |
| 5,033,234 | 7/1991 | Simon et al. | 49/367 |

FOREIGN PATENT DOCUMENTS

| | | |
|---|---|---|
| 0141902 | 5/1985 | European Pat. Off. . |
| 3221534 | 12/1983 | Germany . |
| 3336739 | 4/1985 | Germany . |
| 3604091 | 8/1987 | Germany . |
| 4016283 | 9/1991 | Germany . |
| 9202904 | 6/1992 | Germany . |
| 9209276 | 10/1992 | Germany . |
| 0869837 | 6/1961 | United Kingdom . |

OTHER PUBLICATIONS

"Unsichtbarer Schliessfolgeregler", Baubeschlag magazine, Nov. 1984.

*Primary Examiner*—Philip C. Kannan
*Attorney, Agent, or Firm*—Nils H. Ljungman and Associates

[57] ABSTRACT

A door closing mechanism for a two-panel door having a leading panel and a trailing panel disposed adjacent to one another and being hingedly connected to a door frame. The door closing mechanism controls the closing sequence of a leading panel and a trailing panel, such that a trailing panel is locked in an open position prior to the closing of a leading panel. A locking mechanism, for locking and unlocking the trailing panel, includes a pivoting member which interacts, inter alia, with a sliding block and release member, for pivotally locking and unlocking a locking device. This locking mechanism pivots the pivoting lever into a locking position for preventing the closure of a trailing panel in advance of a leading panel upon a leading panel moving from a closed position to an open position. This locking mechanism can also pivot the pivoting lever into an unlocking position for permitting positioning of a trailing panel into a closed position upon a leading panel being in a closed position. This door closing mechanism can further be designed for concealment within the guide rail and leading and trailing panels.

7 Claims, 6 Drawing Sheets

DOOR CLOSER FOR A TWO-PANEL DOOR WITH A CLOSING SEQUENCE CONTROL MECHANISM

BACKGROUND OF THE INVENTION

1. Field of the Invention

The present invention generally relates to a closing mechanism for a two-panel door which can include a leading or stationary panel and a trailing or moving panel. The door panels are thereby each provided with door closers which are installed invisibly inside the leaves of the door. Above the door, concealed inside the door frame, preferably is a guide rail for the indirect connection of the door closers, which guide rail also holds the mechanical portion of the closing mechanism. Located in the guide rail are two sliding blocks, each of which corresponds to one of the installed door closers, and each of which is preferably connected to the corresponding door closer by means of a hinged pivoting arm.

2. Background Information

German Patent No. 36 04 091 A1, for example, discloses a closing mechanism for two-panel doors which is located inside a guide rail. The guide rail is thereby mounted above the door panel on the door frame. When the leading panel is in the closed position, this known closing mechanism acts on the thrust element, which thrust element is guided in a bearing body and which is in turn firmly fastened to the rail, by means of a transmission block. The transmission block is also movably located in the guide rail, and on the sliding block on the pivoting arm of the leading-panel-side door closer, so that the thrust element forms an abutment for the spring-loaded clamping plate or rail clip which is supported on an overload element. This clamping plate which, when the leading panel is in the closed position, is itself in a position in which a clamping rod which is actively connected to the trailing panel and traverses or runs through the clamping plate, can pass unobstructed through this clamping plate, so that the trailing panel of the door can be actuated without interference.

But, if the leading panel is moved out of its closed position, that necessarily results in a displacement of the sliding block on the leading-panel-side door closer toward the hinge plate of the leading panel, and the thrust element becomes unpressurized, the spring which pressurizes the clamping plate is then able to move the clamping plate into a diagonal position. As a result of the diagonal position of the clamping plate, the clamping plate is clamped on the clamping rod, which simultaneously fixes the trailing panel in its instantaneous open position. As a result of this procedure, it becomes clear to the person using the door that before the trailing panel can be closed, the leading panel must first be moved into its correct closing position, so that an operational closing sequence of the leading and trailing panels can then be carried out. But so that, if an overload occurs on the trailing panel, the trailing panel can also be moved toward its closing position even if the leading panel is slightly open, the overload element which supports the clamping plate is supported in a spring-loaded manner in the direction of the trailing panel. When the trailing panel begins its closing movement, therefore, the clamping plate which is in the diagonal position is moved into a vertical position, so that the clamping rod can then traverse the clamping plate. However, this type of operation requires that the hinge plates be located on the same side of the door as the door closer guide rail with the closing mechanism device.

As a result of a triangle of forces, however, at that moment, another actuation sequence results when, on a two-panel door, the hinge plates are not on the same side as the door closer, the guide rails and the closer mechanism, but are attached to the opposite side. In that case, on account of the geometric relationships, in the event of an opening movement of the individual door panels, the sliding blocks on the pivot arms of the door closers first move the individual door panels slightly in the closing direction, and only then toward the hinge plate side of the door panel. Under some conditions, that can lead to jamming of the closing mechanism of the prior art.

A closing mechanism which can also be installed on the side of the door panel opposite the hinge plate is disclosed in German Patent No. 40 16 283 C1. In the event of an opening movement of the leading panel, the displacement of the sliding block toward the door closing side which occurs at the beginning of the opening phase is used to pivot the engaging and disengaging lever, which is in the top dead center position, beyond its dead center position. This displacement can be effected either by the door panel itself, or indirectly by means of an additional device, so that the thrust element which acts on the clamping plate recedes and thus makes it possible for the spring pressurizing the clamping plate to move the clamping plate, which is mounted in the overload element so that it can pivot, into a diagonal position for clamping on the clamping rod. Consequently, the trailing panel is held in its current opening position. At the same time, to ensure a secure release of the clamping plate when the leading panel is closed, the engaging and disengaging lever is realized in the form of a two-sided or two armed lever. One of these lever arms is mounted on the guide rail, and is connected in a hinged manner on the other end with a forcing lever or push rod which is supported on the thrust element. The second lever arm is connected on one end to the first lever arm, and on the free end of the second lever arm there is a release roller and a release pin to which pressure is applied by the thrust device of the sliding block of the leading panel.

So that the engaging and disengaging lever remains in its closing position effected by the leading panel until a forced release movement is initiated, and also so that a firm connection can be achieved between the lever arms after they have been set, the first lever arm of the engaging and disengaging lever has an angular shape, and in its terminal area has a pin which extends toward the door passage, which pin is provided with gear teeth on the end, and to which the second lever arm can be non-rotationally clamped. On its free end, in the closed position, the leading panel is mounted on a contiguous release roller. Consequently, on one hand, it becomes possible to pivot the engaging and disengaging lever into a top dead center position, and, on the other hand, pressure can be securely applied to the release roller by the leading panel. The actuation of the engaging and disengaging lever from its top dead center position can be achieved if the axle, which axle supports the release roller and is located on the second lever arm of the release lever, has a release pin which projects out of the second lever arm. The release pin can be actuated by an inclined control surface which is located on the thrust device which is connected to the sliding block of the leading panel, to pivot the engaging and disengaging lever. This device essentially guarantees that when the leading panel is opened by the pivoting of the engaging and disengaging lever, the push rod hinged to it is slightly retracted by the thrust element which applies pressure to the clamping plate, so that the clamping plate can move into a locking position to fix the position of the trailing panel as a result of the spring which is applying pressure to the clamping plate.

German Utility Model 92 09 276 describes a top door closer with slide rail rods or linkages for concealed installation in door panels or door frames. The door closer described in this example for invisible installation is designed so that it can be used both for left-opening and right-opening doors which comply with the DIN standards. Its geometric dimensions are also kept small enough that it can also be installed easily in profile framed and braced doors.

OBJECT OF THE INVENTION

The object of the present invention is to create a completely invisible, concealed closing mechanism or servomechanism for two-panel doors, but one in which no floor-level door closers need to be used.

Another object of the present invention is to create a reliable door closing mechanism for controlling the closing sequence of the panels of two-panel doors.

SUMMARY OF THE INVENTION

The present invention teaches that this object can be accomplished, in accordance with at least one preferred embodiment, by installing the door closers in a concealed manner inside both the leading panel and the trailing panel, in the upper portion of each panel. The guide rail is also preferably inserted in a concealed manner above the door panel inside the door frame, so that nothing is visible from the outside, and so that in this case, on the one hand, there is a door closer, and, on the other hand, there is a closing mechanism. The door closers can be connected in a hinged manner to the guide rail by means of pivot arms which are connected on one hand to the drive axle of the door closer, and on the other hand to a sliding block which is guided in the guide rail. An actuator element can also interact with a pivoting engaging and disengaging lever, so that the leading panel is held in a position which holds the locking device in the release position. The engaging and disengaging lever is thereby released in a delayed manner during the opening movement of the leading panel, on account of the overcoming of the dead center position. By means of a thus purely mechanical closing mechanism, which thereby requires no additional electrical, hydraulic or pneumatic energy, a reliable closing mechanism is essentially created which can also be installed invisibly even in fire doors.

When the word "invention" is used in this specification, the word "invention" includes "inventions", that is, the plural of "invention". By stating "invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

One aspect of the present invention resides broadly in a door closing mechanism for a two-panel door having a leading panel and a trailing panel being disposed adjacent to one another in a door frame having hinges for hingedly connecting the panels to the door frame. The door closing mechanism comprises means for controlling the closing sequence of a leading panel and a trailing panel, such that a trailing panel is locked in an open position prior to the closing of a leading panel. The means for controlling the closing sequence of a leading panel and a trailing panel comprises a guide rail and locking means for locking the position of a trailing panel until its corresponding leading panel is closed. The locking means comprises a locking device, and the locking device comprises pivoting means for pivotally locking and unlocking the locking device. The pivoting means comprises a pivoting lever and the locking means comprises means for pivoting the pivoting lever into a locking position for preventing the closure of a trailing panel in advance of a leading panel upon a leading panel moving from a closed position to an open position. The locking means comprises means for pivoting the pivoting lever into an unlocking position for permitting positioning of a trailing panel into a closed position upon a leading panel being in a closed position.

BRIEF DESCRIPTION OF THE DRAWINGS

The invention is explained in greater detail below with reference to the accompanying Figures.

DESCRIPTION OF THE PREFERRED EMBODIMENT

Figure 1:
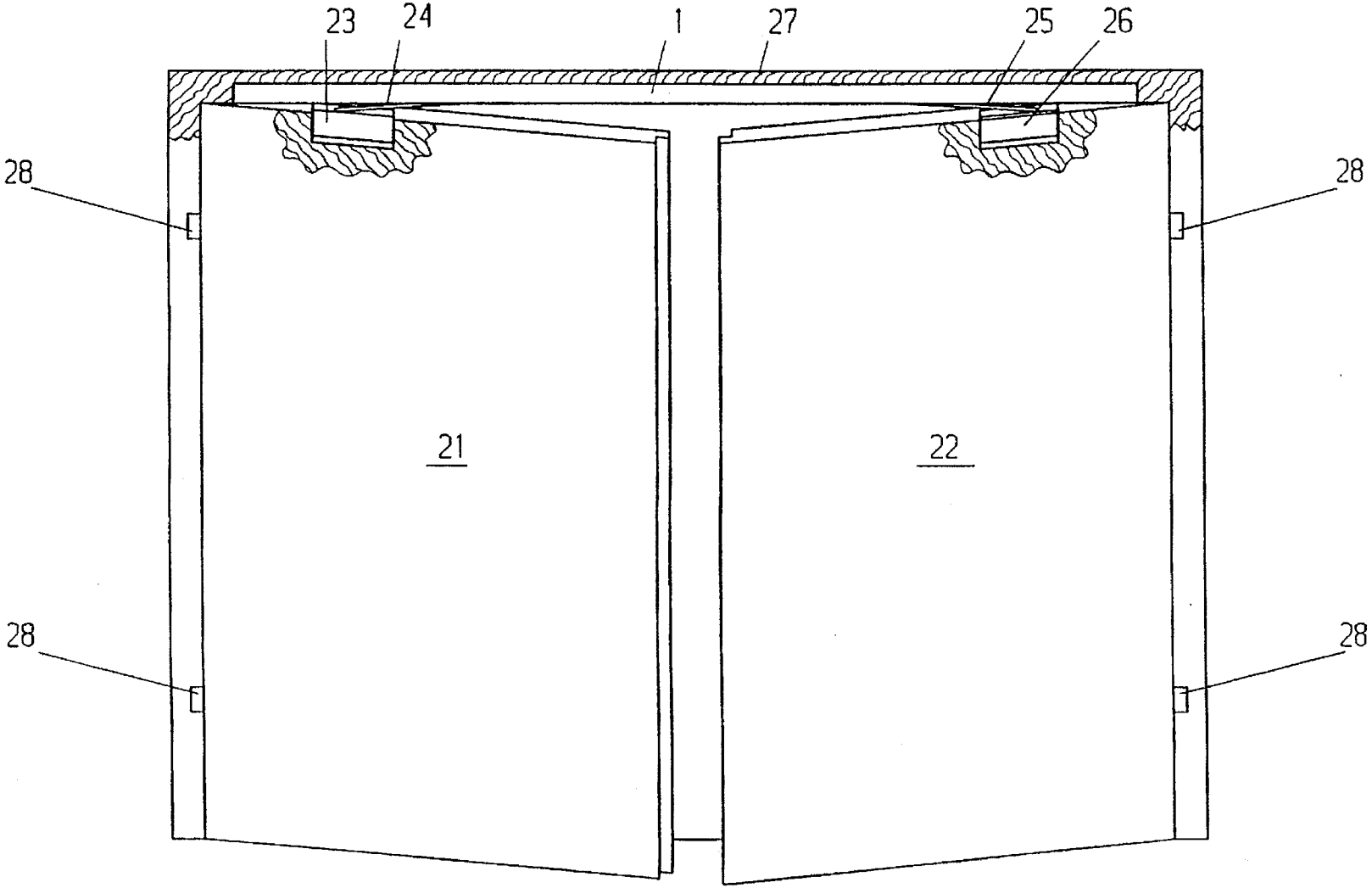
FIG. 1 shows a two-panel door with a closing mechanism which is shown inside the door frame and with a door closer installed inside the doors.

The two-panel door shown in FIG. 1, which can include a leading panel 21 and a trailing panel 22, is rotationally connected to the door frame 27 by means of two hinge plates 28. The leading panel 21 and the trailing panel 22 thereby have a locking seam or locking joint in the center area which guarantees a secure locking or closing of the doors. Inside the door panels 21, 22, which can be realized either in the form of fire doors or as framed and braced doors, and invisibly installed in the upper area, there are preferably door closers 23 and 26. The door closers 23 and 26 are door closers which have been designed for invisible installation. On the closer shaft (not shown), there can be respective pivot arms 24 and 25, the second ends of which are each connected to respective sliding blocks which are each mounted so that they can move inside the guide rail 1. The guide rail 1 is also preferably invisibly installed in the upper area of the door frame 27, so that when the leading panel 21 and the trailing panel 22 are closed, no parts of the door closer or of a closing mechanism are visible. Even when the leading or trailing panels 21, 22 are opened, in this case essentially only the connecting elements between the door closers 23 and 26 and the guide rail 1, namely the pivot arms 24 and 25, are visible from below.

On account of the geometric arrangement and the resulting force relationships, namely of the hinge plates 28, the door closers 23, 26 and sliding blocks which can move in the guide rail 1, these latter parts are not all arranged in a line, so that when one of the door panels are opened, there is necessarily a displacement of the sliding block 3 toward the closing side at the beginning of the opening movement. In other words, and in accordance with one embodiment, it is essentially necessary to overcome a dead center position, such that after the dead center position has been overcome, the sliding block 3 moves securely toward the wall side inside the guide rail 1. This displacement of the sliding block 3 toward the closing side is essentially not noticeable to the persons operating the door, nor does it result in any disadvantages for the persons using the door.

Figure 2:
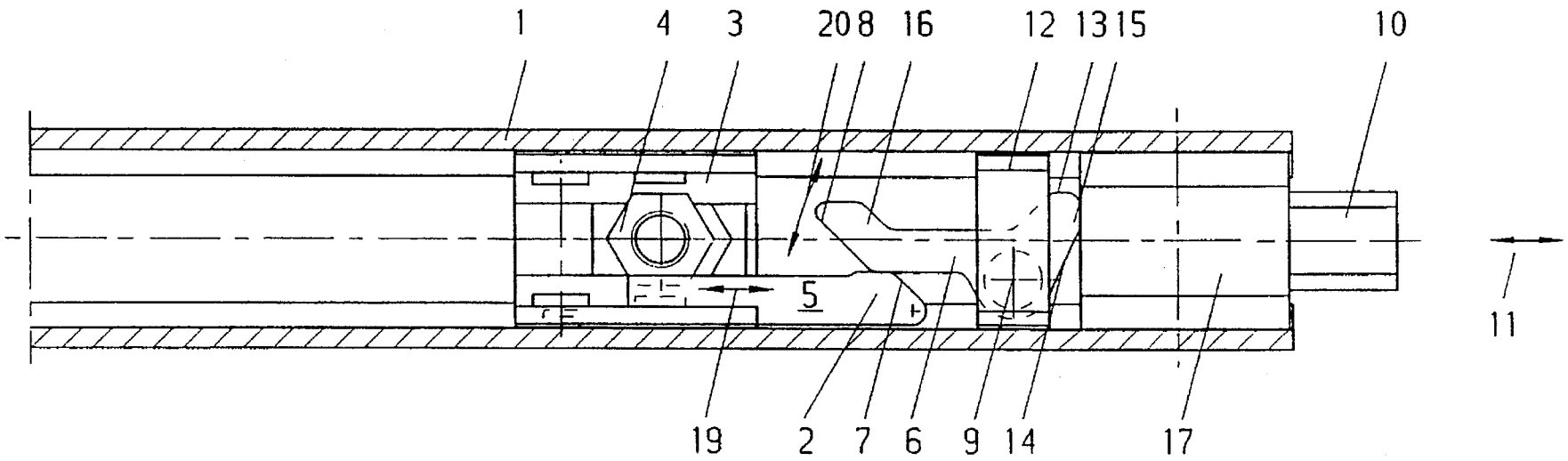
FIG. 2 shows a detail of the guide rail, illustrating the operation of the actuator element, in a view from below.

The portion of the guide rail i shown in FIG. 2 illustrates the preferable interaction of the sliding block 3 of the leading panel 21 with an engaging and disengaging lever 6. The pivot arm 24 of the door closer 23 can be rotationally connected to the sliding block 3 by means of a connection 4. At the same time, on the sliding block 3 there can be a release or trip 5 which is positively and non-positively connected to the sliding block 3. The release 5 can be designed so that it has a deflecting arm 2, on the end of which there is an approach bevel 7. As a result of the opening movement of the leading panel 21, the sliding block 3 is moved with the release 5 in the directions of movement 19.

FIG. 2 shows the leading panel 21 still in the closed position, i.e. the engaging and disengaging lever 6 is also still in the position where the trailing panel 22 can move freely.

The engaging and disengaging lever 6 is preferably a two-armed lever with the lever arms 15, 16. The engaging and disengaging lever 6 can be mounted in a pivot 9. The lever arm 15, which lever arm 15 can preferably be provided with a rounding 13 and an approach bevel 14, preferably interacts with an actuator element 10 which is guided in a guide piece 17. The actuator element 10 can thereby be spring loaded, so that when there is a displacement of the sliding block 3 of the leading panel 21 toward the side of the hinge plate 28, after overcoming the dead center position, the engaging and disengaging lever 6 is pivoted into the direction of movement 20. Consequently, the actuator element 10 is simultaneously pushed in the actuation direction 11, and thereby locks the trailing panel 22. The trailing panel 22 can only be closed again when the release 5 has pivoted the engaging and disengaging lever 6. As the leading panel 21 approaches its closed position, the release 5 with its approach bevel 7 comes together with an approach bevel 8 of the lever arm 16 of the engaging and disengaging lever 6. That results in a pivoting back of the engaging and disengaging lever 6, because on account of the forces exerted by the door closer 23, the spring force which is applying pressure to the actuator element 10 is overcome. After the release lever 6 is pivoted, the actuator element 10 is pushed back and thus simultaneously releases the trailing panel 22, where as a result of the delayed closing moment of the door closer 26, the trailing panel 22 can also be securely moved into the closed position.

Figure 3:
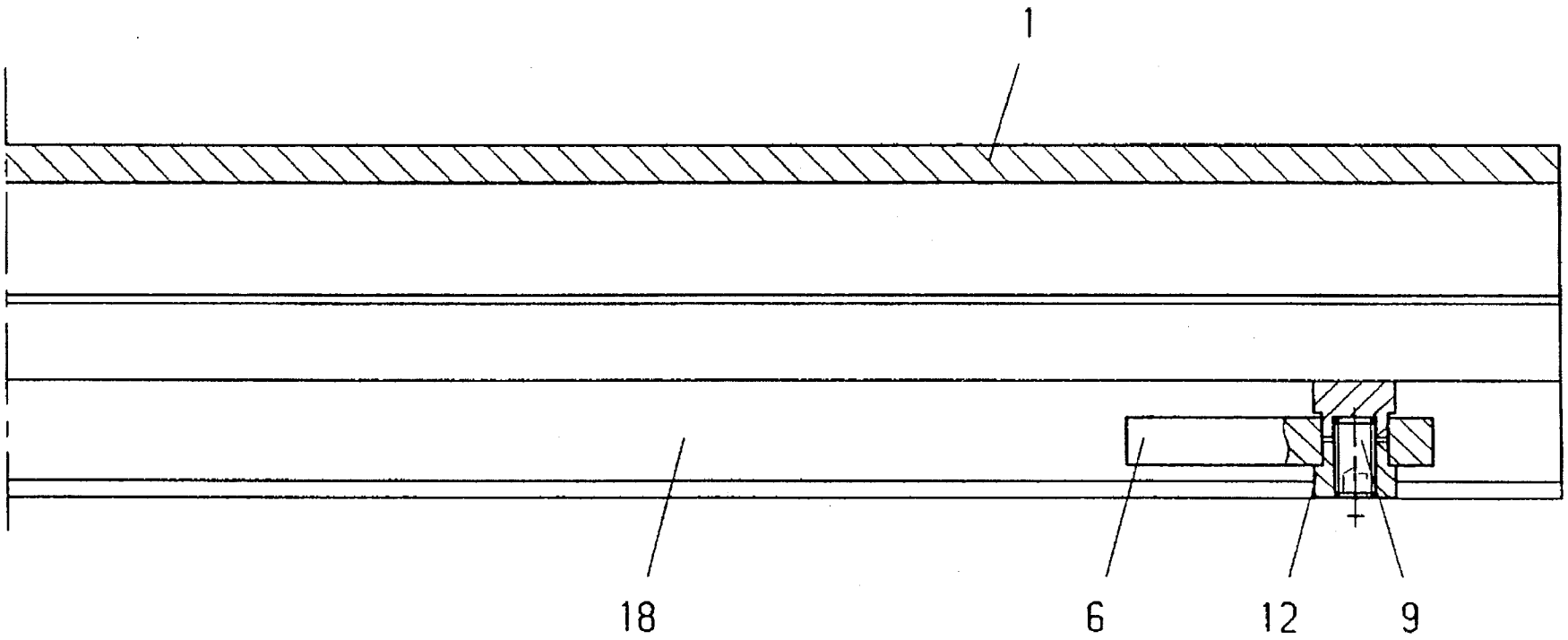
FIG. 3 shows a guide rail in cross section, in a view from the front, with the engaging and disengaging lever.
Figure 3A:
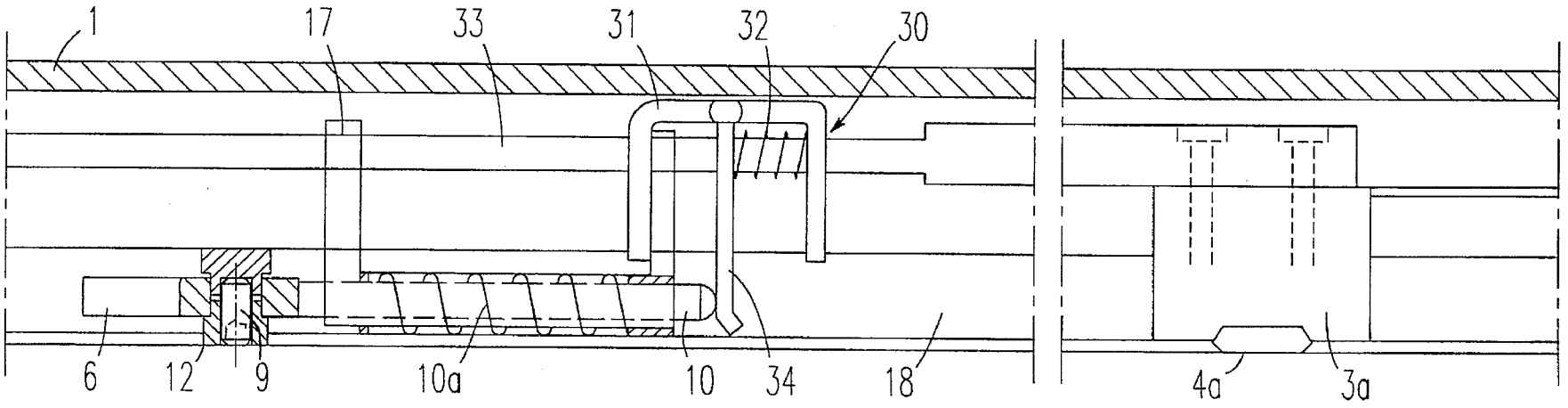
FIG. 3*a* shows a guide rail in cross section, in a view from the front, illustrating a possible example of the operation of an actuator element and one possible locking device.

Possible locking devices that may be used in accord with this embodiment are disclosed, as described above, in German patents Nos. 36 04 091 A1 and DE 40 16 283 C1. Another possible locking device that may be used in accord with the present invention is illustrated in FIG. 3*a*. FIG. 3*a* illustrates one possible interaction of the actuator device 10, with the engaging and disengaging lever 6 and a locking device 30.

In accordance with one embodiment, and as further explanation of the above, due to the arrangement of the hinges 28, sliding block 3 and door closer 23, when the leading panel 21 is opened, the sliding block 3 moves within the guide rail 1 first toward the right or closing side (as illustrated in FIG. 2), until it has overcome a dead center position, then toward the left or hinge side. This is the result of the changing position of the door closer 23, relative to the sliding block 3, as the panel 21 is opened. When the leading panel 21 is closed, the door closer 23 is preferably situated in a position beyond the sliding block 3. Therefore, as the leading panel 21 pivots open on its hinges 28, the door closer 23 moves in an arcing motion which brings the door closer 23 into alignment with the sliding block and then moves the door closer 23 again beyond the sliding block 3 on the opposite side. This arcing pattern of movement of the door closer 23 preferably results in the sliding block 3 initially moving toward the right or closing side of the panel 21, then changing directions and sliding toward the left or hinge side once the door closer 23 has moved beyond the opposite side of the sliding block 3.

Figure 2A:
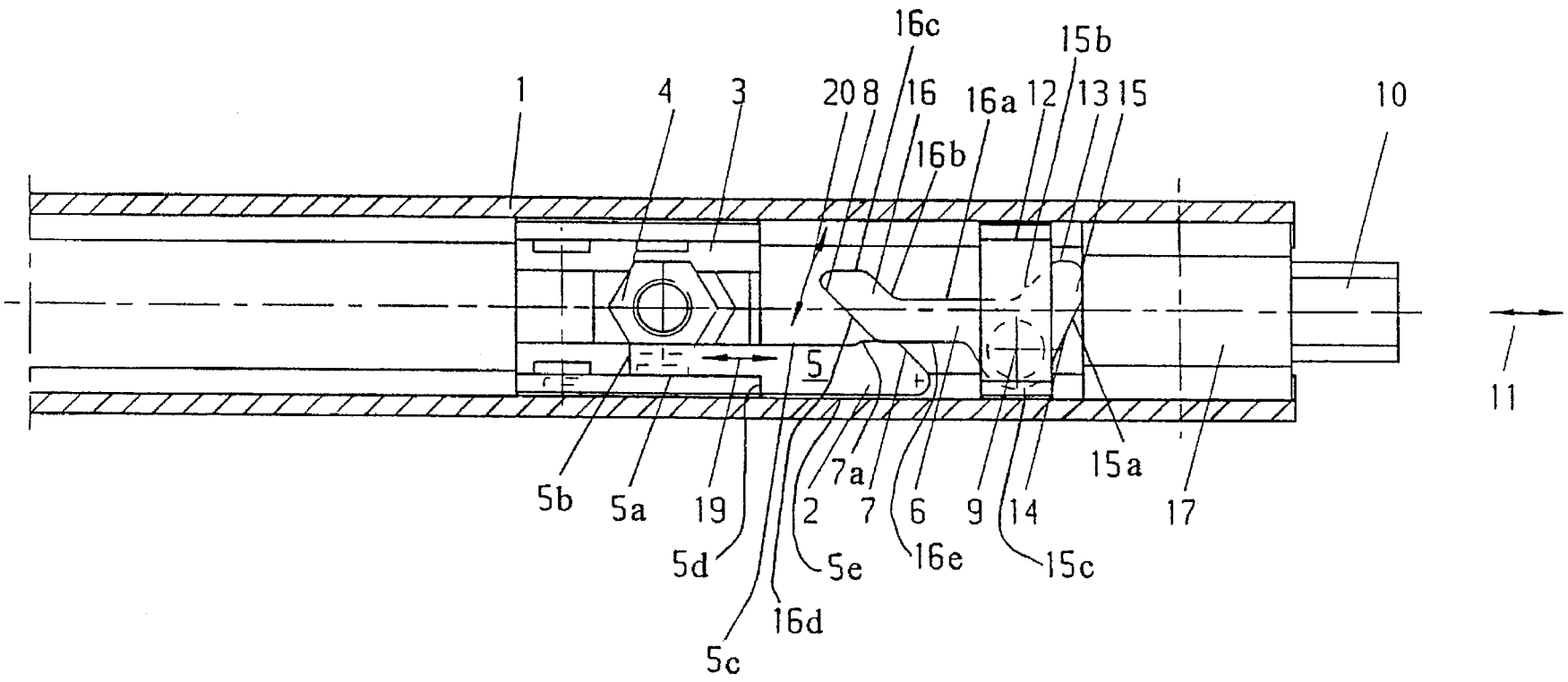
FIG. 2*a* shows essentially the same view as FIG. 2, but is more detailed.

As illustrated in one possible embodiment shown in FIG. 2*a*, attached to the sliding block 3 preferably is the release or trip 5 which moves with the sliding block 3. This release 5 has the deflecting arm 2 with the approach bevel 7 which interacts with the lever arm 16 of the engaging and disengaging lever 6, which lever arm 16 has an approach bevel 8. As the sliding block 3 moves to the left toward the hinge side, the deflecting arm 2, of the release 5, disengages with the lever arm 16 of the engaging and disengaging lever 6. Once the release 5 disengages with the engaging and disengaging lever, the engaging and disengaging lever 6 pivots or rotates on pivot 9. This rotation of the engaging and disengaging lever 6 can be the result of force exerted by the actuator element 10, on the lever arm 15 of the engaging and disengaging lever 6.

As illustrated in FIG. 3*a*, which depicts a cross-section of a front-view of the guide rail 27, in accordance with one embodiment of the present invention, the rotating of the engaging and disengaging lever 6 is the result of the actuator element 10 being spring pressurized toward the engaging and disengaging lever 6. The actuator element 10, in this embodiment, abuts the engaging and disengating lever 6 on the left end of the actuator element 10, and the right end of actuator element 10 abuts a locking device 30. The locking device 30, as illustrated in FIG. 3*a*, can include a clamping plate 34 which is supported on an overload element 31, with the clamping plate 34 being pressurized by a spring 32 to the left, in the direction of the actuator element 10.

When the engaging and disengaging lever is in its unlocked position, as illustrated in the embodiment of FIG. 3*a*, this clamping plate 34 is held by the actuator element 10 in a position which allows a clamping rod 3*a*, which is actively connected to the trailing panel 22, to freely traverse through a hole in the clamping plate 34. This unlocked position allows trailing panel 22 to move freely. But, once the leading panel 21 has been opened, and the release 5 has disengaged with lever arm 16 of the engaging and disengaging lever 6, the engaging and disengaging lever 6 is free to pivot in response to the force extorted by the actuator element 10. In the illustrated embodiment, actuator element 10 has a spring 10*a*, which spring 10*a*, in combination with the spring pressurized clamping plate 34, exerts force on actuator element 10 causing actuator element 10 to move toward the left in the guide rail 1. As the actuator element 10 moves to the left the actuator element 10 simultaneously releases the force it had been asserting on the clamping plate 34. As a result, the spring 32 which pressurizes the clamping plate 34 is then able to move the clamping plate 34 into a diagonal position. This diagonal position causes the clamping plate 34 to become clamped to the clamping rod 33, and thereby prevents the clamping rod 33 from passing through the clamping plate 34. This clamping of clamping rod 33 usually instantaneously fixes the position of the trailing panel 22, which is preferably attached, by means including sliding block 3*a*, connection 4*a*, and pivot arm 25, to clamping rod 33.

In another possible embodiment, spring 10*a*, as shown in FIG. 3*a*, could be eliminated, and the actuator bar 10 could be pressurized to the left solely by the force exerted from clamping plate 34, which clamping plate 34 is under pressure from spring 32.

As illustrated in the embodiment shown in FIG. 2*a*, the engaging and disengaging lever 6 can be designed so as to attach and pivot, or rotate, on pivot 9. The engaging and disengaging lever 6 preferably has the two lever arms 15, 16 extending essentially radially away from the pivot 9, which can be positioned with an initial angle between the two lever arms 15, 16 of approximately 135°. Lever arm 15 can preferably have two side portions 15*a*, 15*b* which extend in a substantially straight direction away from pivot 9. Side portions 15*a* and 15*b* can extend somewhat parallel to one another and terminate in a rounded edge, or rounding 13. In the illustrated embodiment, side portion 15*a* further extends slightly past pivot 9, forming a curved end portion 15*c* adjacent to pivot 9, and approach bevel 14 which, along with rounding 13, is designed to interact with the actuator element 10. Lever arm 16 can have two substantially parallel side portions 16*a*, 16*e* which extend to the left and radially away from the pivot 9. At approximately three-fifths down its length, lever arm 15 can Bend at an angle of approximately 45°, in the direction away from release 5, thereby forming a side portion 16*b*, and a side portion 16*d* with approach bevel 8, for interaction, along with side portion 16*e*, with the release mechanism 5. Connecting the side portions 16*b*, 16*d* is an end portion 16*c*, which is essentially parallel to side portion 16*a*.

The release or trip mechanism 5, as illustrated in FIG. 2*a*, preferably extends longitudinally within the guide rail 1, and can be designed so as to have have two end portions. One end portion can connect with moving block 3, and can include parallel side portions 5*a* and 5*c*. Side portions 5*a* and 5 can terminate with a perpendicular side portion 5*b*. Side portion 5*a* can extend longitudinally, to the right, in the guide rail, until side portion 5*a* reaches the right end of sliding block 3. At the right end of sliding block 3, a side portion 5*d* extends towards the adjacent guide rail 1, perpendicular to side portion 5*a*, thereby expanding the width of release 5. Side portion 5*d* can terminate near the guide rail 1 at which point side portion 5*e* can extend out to the right, in the direction toward the engaging and disengaging lever 6. Side portions 5*c* and 5*e* preferably extend essentially parallel to one another, and terminate with approach bevel 7. Side portion 5*c* also may have a small lip or flange 7*a* toward its terminal end. This bevel 7 and flange 7*a* being designed for interaction with lever arm 16 of the engaging and disengaging lever 6.

Figure 4:
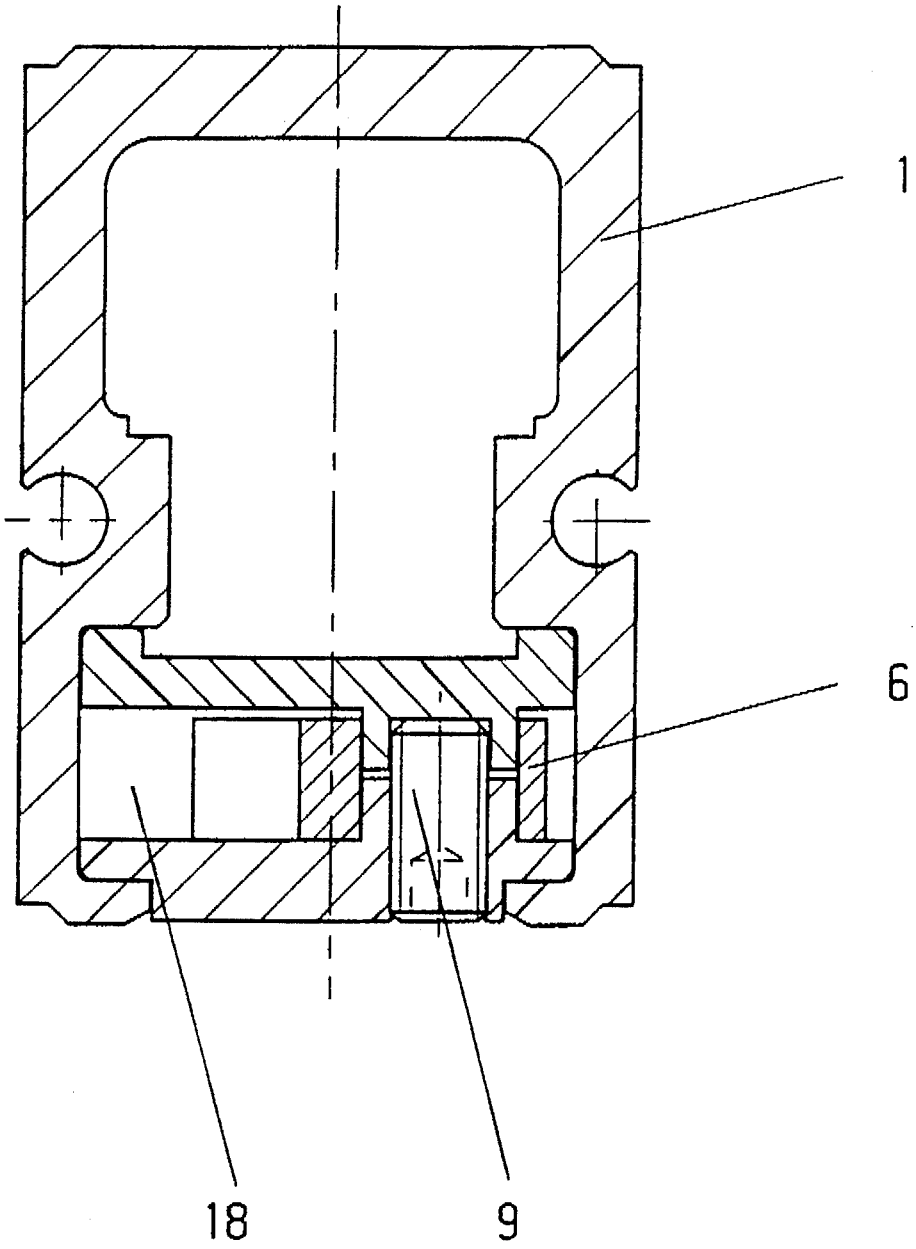
FIG. 4 shows the guide rail in a side view, with the engaging and disengaging lever.

As the preferred embodiment makes clear, in addition to the sliding blocks, all of the mechanical equipment of the closing mechanism located inside the guide rail 1, and thus also the engaging and disengaging lever 6, are invisible to the observer when the two panels 21, 22 are closed. There is also an adjustable mounting 12 inside the guide chamber 18, in which mounting 12 the sliding blocks of the door closers 23 and 26 can also move. The engaging and disengaging lever 6 which can be moved by means of the pivot 9 is preferrably rotationally connected to the mounting 12. This arrangement is also illustrated particularly clearly in FIGS. 3 and 4.

In the embodiment described above, it is assumed that there is a guide rail 1. But it is also possible, for example, to have two guide rails 1 with the closing mechanism installed between them, in which the same functional sequence and thus the same type of control of the trailing panel 22 take place.

One feature of the invention resides broadly in the closing mechanism for a two-panel door, which mechanism has the following features:

- the two-panel door has a leading panel 21 and a trailing panel
- the leading panel 21 and the trailing panel 22 are each connected to door closers 23, 26 which act in the closing direction;
- attached to each of the door closers 23, 26 are respective pivot arms 24, 25, the ends of which are each connected with respective sliding blocks;
- the sliding blocks can move longitudinally in a guide rail 1;
- the sliding block which corresponds to the trailing panel 22 interacts with a locking device which is present in the guide rail 1;
- the locking device 30 is supported on one hand on an actuator element 10 which can be moved by the leading panel 21 into the release position, and on the other hand on an overload element;
- the door closers 23, 26 are each installed in a concealed manner inside the leading panel 21 and the trailing panel 22 respectively, each in the upper portion;
- the guide rail 1 is installed in a concealed manner above the door panel in the door frame 27;
- the actuator element 10 interacts with a pivoting engaging and disengaging lever 6 so that the leading panel 21 is held in a position which protects the locking device 30 in the release position, when the leading panel 21 is closed;
- the engaging and disengaging lever 6 is released on a delayed basis during an opening movement of the leading panel 21.

Another feature of the invention resides broadly in the closing mechanism characterized by the fact that on the sliding block 3 of the leading panel 21, there is a release 5 which interacts with the engaging and disengaging lever 6.

Yet another feature of the invention resides broadly in the closing mechanism characterized by the fact that the release 5 can be pushed past the engaging and disengaging lever 6 at the beginning of the opening movement of the leading panel 21.

Still another feature of the invention resides broadly in the closing mechanism characterized by the fact that the release 5 is fastened on one side and has an approach bevel 7 on a deflecting arm 2 on its end.

A further feature of the invention resides broadly in the closing mechanism characterized by the fact that the engaging and disengaging lever 6, viewed from its pivot 9, has a lever arm 16 and a lever arm 15, each of which is provided with an approach bevel 8, 14.

Another feature of the invention resides broadly in the closing mechanism characterized by the fact that the mounting 12 of the engaging and disengaging lever 6 inside the guide rail 1 is adjustable.

Examples of apparatuses for controlling the closing sequence of double doors and components thereof which could possibly be used in conjunction with the embodiments of the present invention as set forth hereabove can possibly be found in U.S. Pat. No. 5,033,234, entitled "Door Coordinator"; U.S. Pat. No. 4,653,229, entitled "Holding Installation for Double Doors"; U.S. Pat. No. 4,663,887, entitled "Apparatus for Controlling the Closing Sequence of Double Doors"; and U.S. Pat. No. 4,583,324, entitled "Apparatus for Controlling the Closing Sequence of Double Leaved Doors."

Examples of door closers and/or components thereof which could possibly be used in conjunction with the embodiments of the present invention as set forth hereabove can possibly be found in U.S. Pat. No. 5,417,013, entitled "Overhead Door Closer With Slide Rail for Concealed Installation in Door Panels or Door Frames"; U.S. Pat. No. 5,461,754, entitled "Door Closer With a Detent for Holding a Door Open and the Detent Therefor"; U.S. Pat. No. 5,369,912, entitled "Door and Method for Operating a Door"; U.S. Pat. No. 5,205,015, entitled "Door Hinge with Automatic Returning Means"; U.S. Pat. No. 5,222,328, entitled "Automatic Opening and Closing Device for Back Door"; U.S. Pat. No. 5,265,306, entitled "Automatic Door Closing Device"; U.S. Pat. No. 5,265,311, entitled "Self Closing Hinge"; and U.S. Pat. No. 5,333,355, entitled "Adjustable Automatic Door Closure Apparatus and Method for Use Thereof."

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. 295 01 776.7, filed on Feb. 7, 1995, having inventor Horst Tillmann, and DE-OS 295 01 776.7 and DE-PS 295 01 776.7, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

Nomenclature

1 Guide rail
2 Arm
3 Sliding block
**3*a*** Sliding black
4 Connector
**4*a*** Connector
5 Release
6 Engaging and disengaging lever
7 Approach bevel
8 Approach bevel
9 pivot
10 Actuator element
**10*a*** Spring
11 Actuator device
12 Mounting
13 Rounding
14 Approach bevel
15 Lever arm
**15*a*** Side portion
**15*b*** Side portion
**15*c*** End portion
16 Lever arm
**16*a*** Side portion
**16*b*** Side portion
**16*c*** End portion
**16*d*** Side portion
**16*e*** Side portion
17 Guide piece
18 Guide chamber
19 Movement device
20 Movement device
21 Stationary panel
22 Moving panel
23 Door closer
24 Pivot arm
25 Pivot arm
26 Door closer
27 Door frame
28 Hinge plates
30 Locking device
31 Overload element
32 Spring
33 Clamping rod
34 Clamping plate

What is claimed is:

1. A door closing mechanism for a two-panel door having a leading panel and a trailing panel being disposed adjacent to one another in a door frame having hinges for hingedly connecting the panels to the door frame, said door closing mechanism comprising:

means for controlling the closing sequence of a leading panel and a trailing panel, such that a trailing panel is locked in an open position prior to the closing of a leading panel;

said means for controlling the closing sequence of a leading panel and a trailing panel comprising:

a guide rail;

locking means for locking the position of a trailing panel until its corresponding leading panel is closed;

said locking means being disposed at least in part in said guide rail;

said locking means comprising a locking device; said locking device comprising pivoting means for pivotally locking and unlocking said locking device;

said pivoting means comprising a pivoting lever;

said locking means comprising means for pivoting said pivoting lever into a locking position for preventing the closure of a trailing panel in advance of a leading panel upon a leading panel moving from a closed position to an open position;

said locking means comprising means for pivoting said pivoting lever into an unlocking position for permitting positioning of a trailing panel into a closed position upon a leading panel being in a closed position;

said locking means comprising means for delaying locking of said locking means upon opening a leading panel from a closed position of a leading panel until a leading panel is in a partially open position;

said guide rail defining a longitudinal direction for permitting movement therein longitudinally;

at least a portion of said locking device comprising a first movable mechanism disposed in said guide rail so as to permit movement longitudinally of said first movable mechanism within said guide rail;

at least a portion of said means for pivoting said pivoting lever into a locking position and at least a portion of said means for pivoting said pivoting lever into an unlocking position being attached to said first movable mechanism;

said first movable mechanism comprising means for being connected to a leading panel;

at least a portion of said locking device comprising a second movable mechanism disposed in said guide rail so as to permit movement longitudinally of said second movable mechanism within said guide rail;

said second movable mechanism comprising means for being connected to a trailing panel;

said means for pivoting said pivoting lever into a locking position and said means for pivoting said pivoting lever into an unlocking position comprising a release element disposed within said guide rail;

said release element having a beveled edge disposed adjacent to said pivoting lever;

said beveled edge being configured for engaging and disengaging with said pivoting lever;

said release element being attached to said first movable mechanism;

said beveled edge of said release element being disposed to be movable past a portion of said pivoting lever;

said portion of said pivoting lever comprises at least in part a first beveled edge;

said first beveled edge of said pivoting lever being disposed adjacent to said beveled edge of said release element to thereby fascilitate said engaging and disengaging of said release element and said pivoting lever;

at least a portion of said locking device comprising an actuator bar disposed within said guide rail;

said actuator bar having a first portion and a second portion;

said first portion comprising an end part;

said pivoting lever further comprises a second beveled edge;

said end part of said first portion of said actuator bar being disposed adjacent and in contact with said second beveled edge of said pivoting lever;

said locking means comprising means for locking a trailing panel in an open position;

said second portion of said actuator bar being disposed adjacent said means for locking a trailing panel in an open position; and said second portion of said actuator bar being disposed to engage and to disengage with said means for locking a trailing panel in an open position.

2. The door closing mechanism according to claim 1 wherein:

at least a portion of said locking device comprises a block disposed in said guide rail;

said pivoting lever being pivotally connected to said block; and said pivotal connection of said pivoting lever to said block comprises a pivot.

3. The door closing mechanism according to claim 2 wherein at least a portion of said locking device comprises means for selectively locating said block at a predetermined position within said guide rail.

4. The door closing mechanism according to claim 3, wherein:

said means for connecting said first movable mechanism to a leading panel comprises:

a first pivotal arm member;

a first rotational connecting element;

said first rotational connecting element being disposed between, and joining, said first pivotal arm member and said first movable mechanism;

a first door closing device;

said first door closing device being mounted on a leading panel and being disposed so as to connect said leading panel and said said first pivotal arm member;

said means for connecting said second movable mechanism to a trailing panel comprises:

a second pivotal arm member;

a second rotational connecting element;

said second rotational connecting element being disposed between, and joining, said second pivotal arm member and said second movable mechanism;

a second door closing device;

said second door closing device being mounted on a trailing panel and being disposed so as to connect said trailing panel and said second pivotal arm member.

5. The door closing mechanism according to claim 4 wherein:

said first door closing device is configured to be mountable within a leading panel and concealed therein; and said second door closing device is configured to be mountable within a trailing panel and concealed therein.

6. The door closing mechanism according to claim 5 wherein said guide rail is disposed in a concealed manner within a member of a door mounting frame above door panels.

7. The door closing mechanism according to claim 6 wherein:

said pivoting lever comprises a first lever arm and a second lever arm;

said first lever arm and said second lever arm being joined at a connecting point;

said connecting point being disposed at said pivot;

said first and second lever arms each extending substantially radially from said pivot;

said first lever arm having a first portion and a second portion;

said first portion of said first lever arm extends substantially radially away from said pivot;

said first and second lever arms being disposed so as to form an angle between said first portion of said first lever arm and said second lever arm of about 135°;

said first portion of said first lever arm has a first end and a second end being disposed substantially away from one another;

said first end of said first portion of said first lever arm being disposed adjacent said pivot;

said second end of said first portion of said first lever arm being disposed at a substantial distance from said pivot;

said second portion of said first lever arm extends substantially radially away from said second end of said first portion of said first lever arm, said second portion of said first lever arm being disposed so as to form a 135° angle with said first portion of said first lever arm, said second portion extends at said 135° angle in a direction away from said release element upon said pivoting lever being pivoted into said unlocking position;

said second portion of said first lever arm comprises an end part;

said end part of said second portion of said first lever arm being substantially flat;

said end part of said second portion of said first lever arm being substantially parallel to said first portion of said first lever arm;

said first beveled edge being disposed on said second portion of said first lever arm;

said first beveled edge being disposed so as to allow said first lever arm to enagage and to disengage with said release;

said second lever arm comprises two end portions;

said two end portions of said second lever arm being disposed a substantial distance from one another;

said first end portion of said second lever arm comprises a first curved end part being disposed about said pivot;

said second end portion of said second lever arm being disposed a distance away from said pivot;

said second end portion of said second lever arm being disposed a distance away from said first end portion of said second lever arm;

said second end portion of said second lever arm comprises a second curved end part;

said second beveled edge being disposed between said first end portion of said second lever arm and said second end portion of said second lever arm; and said second lever arm being disposed adjacent to said actuator bar so as to allow said actuator bar and said second lever to come in contact and exert force on one another.

* * * * *

UNITED STATES PATENT AND TRADEMARK OFFICE

CERTIFICATE OF CORRECTION

PATENT NO. : 5,651,216

DATED : July 29, 1997

INVENTOR(S) : Horst TILLMANN

It is certified that error appears in the above-identified patent and that said Letters Patent is hereby corrected as shown below:

In column 5, line 11, after 'rail', delete "i" and insert --l--.

In column 6, line 50, after 'rod', delete "3a," and insert --33,--.

In column 8, line 13, after 'panel' insert --22;--.

Signed and Sealed this

Ninth Day of December, 1997

*Attest:*

Bruce Lehman

BRUCE LEHMAN

*Attesting Officer*

*Commissioner of Patents and Trademarks*